United States Patent [19]

Thouault et al.

[11] 4,425,902

[45] Jan. 17, 1984

[54] SUBMERSIBLE DEVICE FOR HEATING LIQUIDS

[75] Inventors: Alain Thouault, Paris; Claude Chapuis, Epinay sur Seine; Georges Austruy, St. Denis, all of France

[73] Assignee: Gaz de France, France

[21] Appl. No.: 366,308

[22] Filed: Apr. 7, 1982

[30] Foreign Application Priority Data

Apr. 8, 1981 [FR] France ..... 81 07059

[51] Int. Cl.[3] ..... F24H 1/20

[52] U.S. Cl. ..... 126/360 R; 122/33; 126/368

[58] Field of Search ..... 126/350 R, 360 R, 360 A, 126/368; 122/14, 23, 33

[56] References Cited

U.S. PATENT DOCUMENTS

| | | | |
|---|---|---|---|
| 1,640,943 | 8/1927 | Kass | 126/360 R |
| 2,506,853 | 5/1945 | Berg et al. | 126/360 R |
| 3,021,833 | 2/1962 | Kohorst | 126/360 R |
| 3,051,162 | 8/1962 | Porter | 126/360 R |

FOREIGN PATENT DOCUMENTS

| | | |
|---|---|---|
| 665713 | 6/1965 | Belgium . |
| 942656 | 5/1956 | Fed. Rep. of Germany . |
| 669975 | 4/1952 | United Kingdom . |

*Primary Examiner*—Edward G. Favors
*Assistant Examiner*—Steven E. Warner
*Attorney, Agent, or Firm*—Steinberg & Raskin

[57] ABSTRACT

A gas burner associated with a combustion chamber constitutes a fluid-tight removable heating unit immersible in a liquid to be heated. The unit has a caisson including a chamber for premixing and distributing gaseous fuel and a combustion chamber separated from the premixing chamber by a flame stabilizing grate. The caisson has traversed, in fluid-tight relationship thereto, by ducts permitting thermosiphon circulation of the surrounding liquid and increasing the exchange surfaces constituted by the walls of the caisson.

4 Claims, 6 Drawing Figures

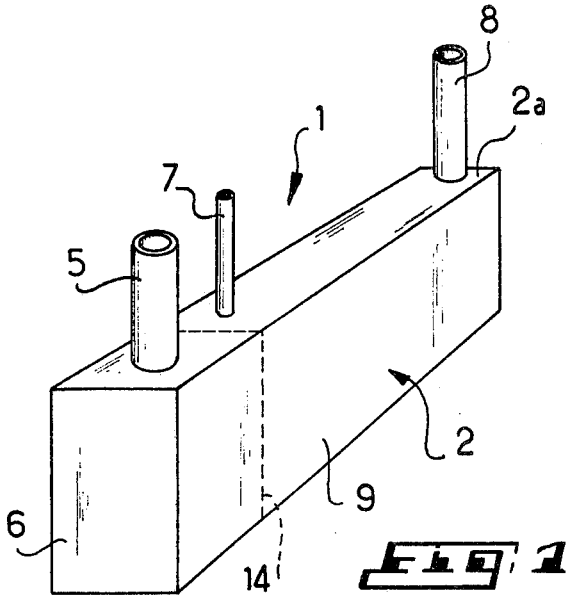
Fig. 1
Fig. 4
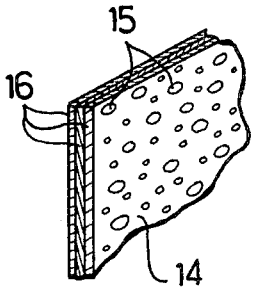
Fig. 2
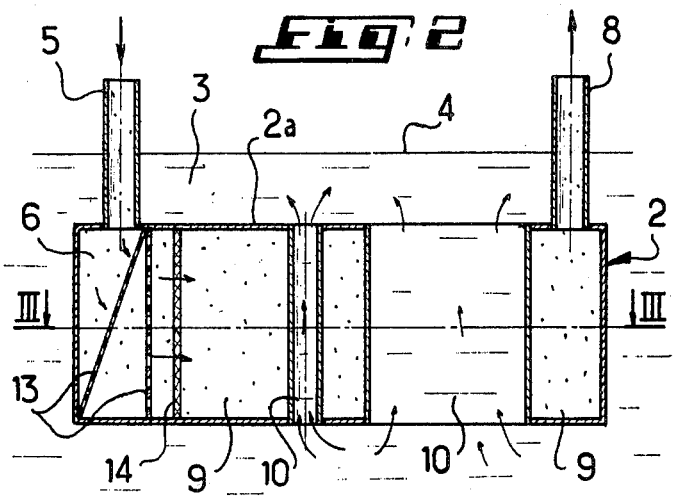
Fig. 5
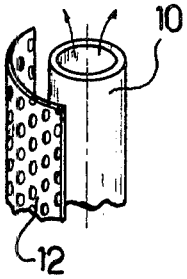
Fig. 6
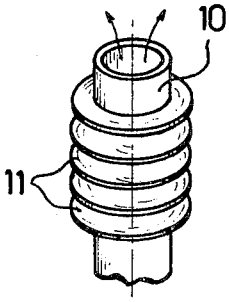
Fig. 3
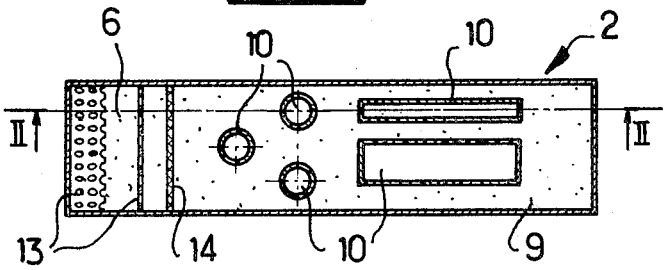

SUBMERSIBLE DEVICE FOR HEATING LIQUIDS

BACKGROUND OF THE INVENTION

The present invention relates to in situ heating of industrial liquids. More particularly, the invention relates to a submersible device for heating liquids.

A number of means for in situ heating of industrial liquids by means of gases have been proposed. As a rule, the heating is obtained by means of arrangements provided in the tank or like receptacle containing the liquid to be heated. However, such arrangements are stationary, sometimes create problems of care and maintenance and occupy considerable space while usually being of low efficiency.

The purpose of the present invention is to remedy particularly the aforementioned drawbacks by providing a new heating device which, in a way, is independent of the tank containing the liquid to be heated and offers high flexibility in use.

SUMMARY OF THE INVENTION

The principal object of the invention is to provide a submersible device for heating liquids, which device is a compact immersion heater.

An object of the invention is to provide a submersible device for heating liquids, which device is compact and removable.

Another object of the invention is to provide a submersible device for heating liquids, maintenance of which device is considerably facilitated, compared to known apparatus utilizing a burner outside the tank containing liquid to be heated.

To accomplish this, the device of the invention is for heating any liquid by the burnt gases produced in a combustion chamber associated with a burner. The burner and its associated combustion chamber constitute a movable fluid-tight heating unit immersible in the liquid to be heated.

The immersible heating device according to the invention is a compact immersion heater using gaseous fuel.

In accordance with the invention, the aforesaid heating unit is in the form of a caisson, at least one of the walls of which is provided with conduits or the like opening above the level of the liquid and permitting the feeding of fuel, the exit of the exhaust gases and the passage of electrical ignition and safety connections or lines to the burner, respectively.

It is thus understood that the walls of the heating-unit caisson constitute as many exchange surfaces.

In accordance with another feature of the invention, the caisson portion constituting the combustion chamber is traversed, in fluid-tight relationship thereto, by one or several thermosiphon circulation ducts for the surrounding liquid. Such ducts advantageously increase the exchange surface.

In accordance with still another feature of the invention, the aforesaid combustion chamber comprises means such as, for example, grates or the like, creating hot gas turbulence preferably around the ducts.

Furthermore, the external periphery of the ducts may be provided with ribs additionally increasing the exchange surface.

In accordance with yet another feature of the invention, the aforesaid caisson has substantially the shape of a parallelepiped comprising a fuel premixing and homogenizing chamber separated from the combustion chamber by a flame stabilizing grate, or the like. The premixing chamber contains one or several grates for distributing the fuel prior to combustion.

BRIEF DESCRIPTION OF THE DRAWINGS

For a fuller understanding of the invention, reference is had to the following description, taken in connection with the accompanying drawings, in which:

FIG. 1 is a diagrammatic perspective view of an embodiment of the immersible heating device of the invention;

FIG. 2 is an elevational and vertical sectional view of the embodiment of FIG. 1, taken along the lines II—II, of FIG. 3;

FIG. 3 is a sectional view of the embodiment of FIG. 1, taken along the lines III—III, of FIG. 2;

FIG. 4 is a partial perspective view, on an enlarged scale, of an embodiment of the flame stabilizing grate of FIGS. 2 and 3;

FIG. 5 is a partial perspective view, on an enlarged scale, of a duct traversing the combustion chamber of FIGS. 2 and 3 and with which is associated a means for creating hot gas turbulence; and FIG. 6 is a partial perspective view, on an enlarged scale of a ribbed duct of FIGS. 1 to 3.

DESCRIPTION OF PREFERRED EMBODIMENTS

In one embodiment thereof, the heating device of the invention comprises essentially a compact heating assembly 1 in the form of a preferably parallelepiped caisson 2 entirely immersible into a liquid 3 to be heated. This liquid may be, for example, an industrial liquid contained in a tank (not shown in the figures). The liquid 3 has a level 4, as shown in in FIG. 2.

The heating unit or caisson 2 has six walls constituting as many exchange surfaces. One wall 2*a* of the caisson is provided with conduits opening above the level 4 of the liquid 3, as seen clearly in FIG. 2. More precisely, combustible gas and combustive air in a substantially stoichiometric amount is supplied through a conduit 5 opening into a fuel premixing and homogenizing chamber 6, as seen in FIGS. 2 and 3. Another conduit 7 (FIG. 1) is provided for the passage of the electrical ignition and safety connections or lines of the burner. Lastly, the exhaust gases are discharged through a third conduit 8 which opens into the combustion chamber 9.

As appears clearly in FIGS. 2 and 3, that portion of the caisson 2 which constitutes the combustion chamber 9 is traversed, in fluid-tight relationship thereto, by one or several ducts such as 10. The ducts 10 may have any cross-sectional shape, e.g. circular or polygonal, as seen clearly in FIG. 3. They permit thermosiphon circulation of the surrounding liquid 3, as shown by the arrows in FIG. 2. The vertical ducts 10 advantageously increase the external exchange surface constituted by the walls of the caisson 2.

The exchange surface may be increased additionally by providing metal annular ribs, fins or the like 11 around the ducts 10, as seen for example, in FIG. 6.

The portion of the caisson 2 that contains the flame and constitutes the combustion chamber 9 is preferably provided with means for creating turbulent flows of hot gases within this chamber to improve the performance of the heating unit 1 while reducing the space occupied to a minimum. Any such means may be used and arranged in any manner in the combustion chamber 9 and may constitute, for example, grates 12 provided around the ducts 10 as seen in FIG. 5. The grates 12 thus favor the formation of hot gas jets directed towards the exchange walls provided by the ducts 10.

The premixing chamber 6 advantageously contains one or several grates 13 suitably arranged within said chamber to ensure a perfect distribution of the gaseous mixture arriving through the conduit 5.

A flame stabilizing grate 14 separates the gaseous fuel premixing and distributing chamber 6 from the combustion chamber 9. The grate 14, which is shown on a larger scale in FIG. 4, is preferably constituted by a metal plate provided with one or several sets of holes 15, said plate being constituted by several superposed and assembled metal plates, sheets, wire cloths or the like 16, themselves provided with holes as described, for example, in French Patent No. 2,063,803 owned by the applicant. The grate 14 advantageously ensures a high combustion intensity resulting in heating powers up to 2 $kW/cm^2$.

The gas burner of the invention thus insures a high combustion intensity and is associated with a combustion chamber to constitute a very compact, removable, multipurpose heating unit capable of being very easily immersed by a winch, for example, in a tank containing any kind of liquid to be heated.

The heating unit of the invention may reach a heating power up to 1000 to 2000 kW per occupied cum, and the efficiencies obtained with such a unit are higher by about 20% than those of the liquid heating facilities used hitherto.

Of course, the invention is by no means limited to the form of embodiment described and illustrated, which has been given by way of example only. Thus, for example, the means 12 producing turbulence in the combustion chamber 9 may have any structure and arrangement, the distributing grates in the premixing chamber 6 may be of any number and of any structure, and the vertical ducts 10 in the combustion chamber formed within the caisson 2 may also be of any number and any shape. Furthermore, the shape of the caisson may be other than parallelepiped.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A submersible device for heating liquids, comprising a parallelepiped caisson immersible in a liquid to be heated and having a top wall and a bottom wall, said caisson having a first portion and a second portion;

a combustion chamber in said first portion of said caisson and having vertical ducts traversing said combustion chamber between said top and bottom walls of said caisson in fluid-tight relationship therewith;

a fuel premixing and homogenizing chamber forming said second portion of the said caisson;

at least one flame stabilizing grate arranged between the walls of said caisson and separating said second portion of said caisson from said first portion thereof;

at least one conduit opening above said liquid and connected to said second portion of said caisson for feeding fuel to said premixing and homogenizing chamber; and at least another conduit opening above said liquid and connected to said first portion of said caisson for conducting exhaust gases from said combustion chamber.

2. A device as claimed in claim 1, further comprising grates provided around said vertical ducts traversing said caisson to produce hot gas jets around said ducts.

3. A device as claimed in claim 1, wherein said premixing and homogenizing chamber includes grate means therein for distributing the fuel supplied via said one conduit.

4. A device as claimed in claim 1, wherein said vertical ducts have annular fins therearound.

* * * * *